US005859393A

United States Patent [19]

Cummins, Jr. et al.

[11] Patent Number: 5,859,393

[45] Date of Patent: Jan. 12, 1999

[54] REDUCED COST VENT SILENCER

[75] Inventors: Jim R. Cummins, Jr., Verona; Lee H. Moritz, Monona; Daniel M. Brazys, Richland Center; Jeffery L. Weeden, Blue River; Ronald W. Kendziera, Boscobel, all of Wis.

[73] Assignee: Nelson Industries, Inc., Stoughton, Wis.

[21] Appl. No.: 858,516

[22] Filed: May 19, 1997

[51] Int. Cl.[6] ..... F01N 1/24

[52] U.S. Cl. ..... 181/257; 181/224; 181/275

[58] Field of Search ..... 181/224, 252, 181/255, 256, 257, 258, 264, 268, 269, 272, 275, 282, 293

[56] References Cited

U.S. PATENT DOCUMENTS

| | | | |
|---|---|---|---|
| 2,640,557 | 6/1953 | Gaffney . | |
| 2,764,250 | 9/1956 | Jeffords . | |
| 2,998,860 | 9/1961 | Everett . | |
| 3,454,129 | 7/1969 | Everett | 181/224 |
| 3,776,365 | 12/1973 | Richards . | |
| 4,105,089 | 8/1978 | Judd | 181/264 |
| 4,108,276 | 8/1978 | Hall et al. . | |
| 4,127,183 | 11/1978 | McLarty . | |
| 4,375,841 | 3/1983 | Vielbig . | |
| 5,477,015 | 12/1995 | Preslicka et al. | 181/282 |
| 5,491,310 | 2/1996 | Jen | 181/293 |
| 5,532,439 | 7/1996 | Minkin . | |
| 5,545,860 | 8/1996 | Wilkes | 181/255 |
| 5,696,361 | 12/1997 | Chen | 181/224 |

*Primary Examiner*—Khanh Dang
*Attorney, Agent, or Firm*—Andrus, Sceales, Starke & Sawall

[57] ABSTRACT

An acoustical silencer (10) includes a housing (12) extending generally axially vertically upwardly from an inlet (14) to an outlet (16). A laterally extending upper divider wall (18) is attached to the housing and has a plurality of apertures (22) therethrough. A plurality of tubes (24, 34) extend axially vertically through respective apertures and have an integral bulge (26) crimped radially outwardly to a larger radius than the aperture and engaging the topside of the upper divider wall to suspend the tube therefrom. A laterally extending lower divider wall (28) has a plurality of apertures (30) therethrough. The tubes extend axially vertically through the apertures of the lower divider wall and some have integral bulges (32) crimped radially outwardly to a larger radius than the aperture of the lower divider wall and engage the underside of the lower divider wall to suspend the latter from the tubes. The tubes are continuous spiral-wound perforated members completely weldless, including along their entire length and including at their interface with each of the divider walls. The structure reduces manufacturing cost, and enables large cross sectional flow area without sacrificing length to diameter tube grade ratios.

11 Claims, 2 Drawing Sheets

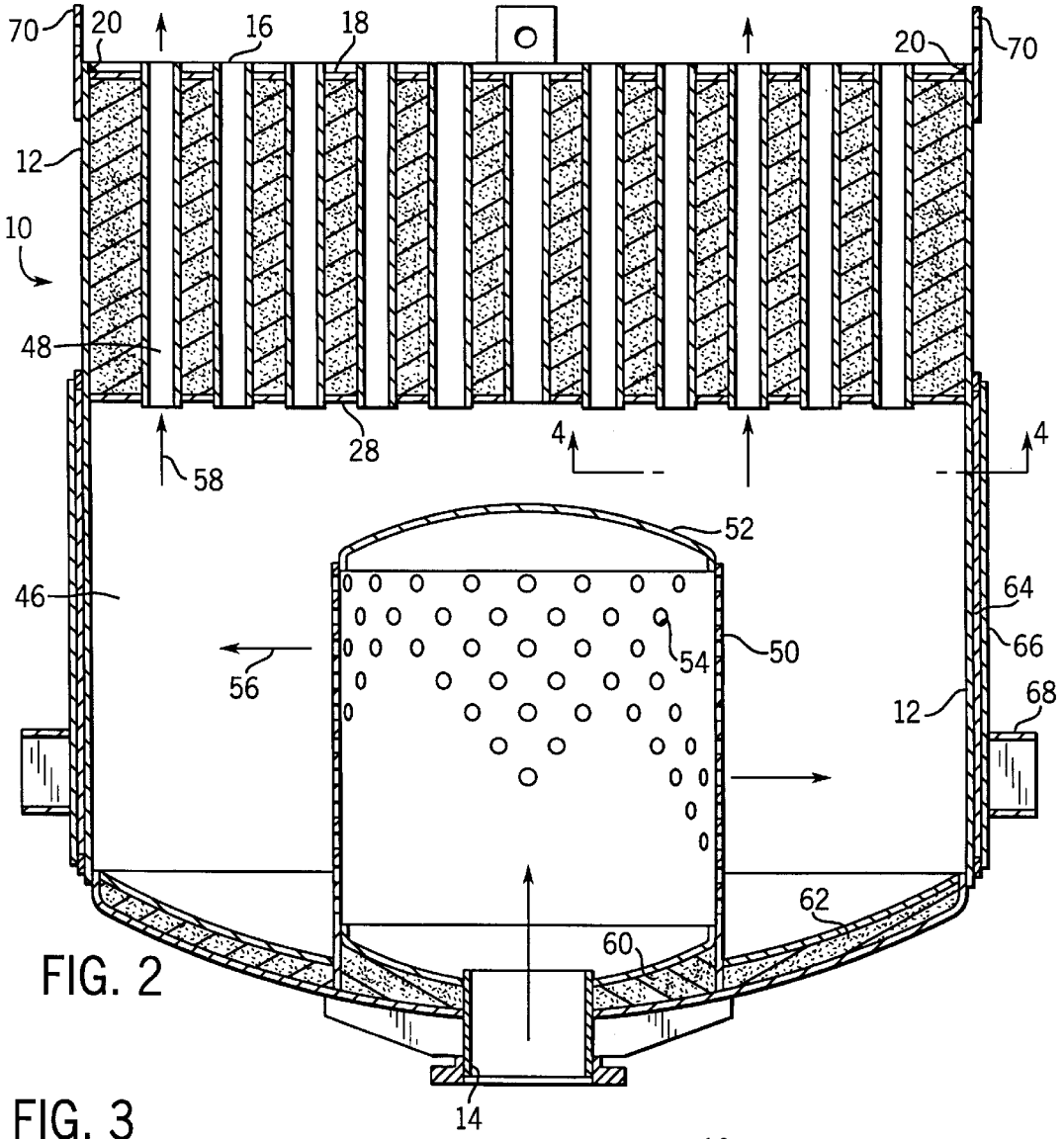
FIG. 2
FIG. 3
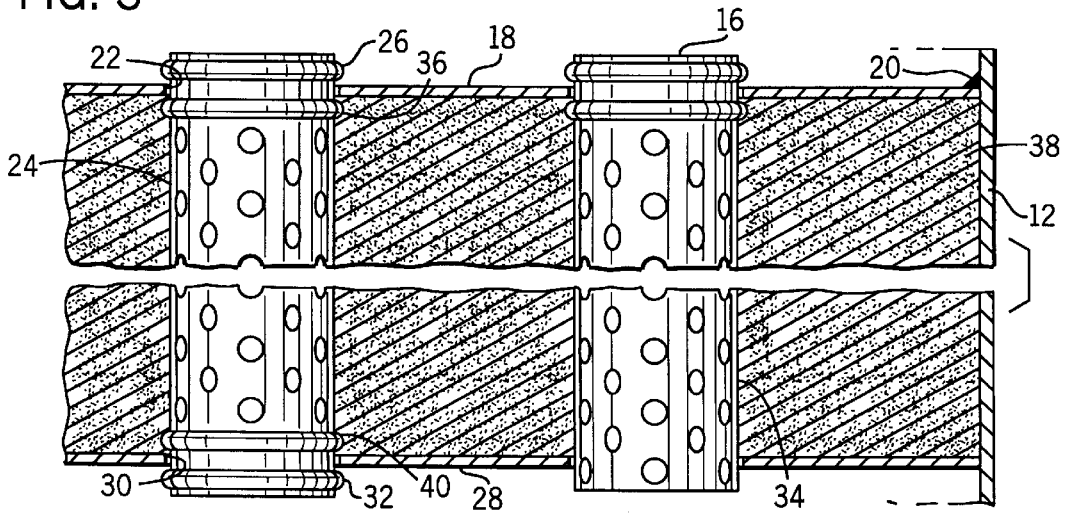

REDUCED COST VENT SILENCER

BACKGROUND AND SUMMARY

The invention relates to acoustical silencers, including vent silencers. The invention arose during continuing development efforts related to the vent silencer shown in Hall et al U.S. Pat. No. 4,108,276, incorporated herein by reference, though the invention has numerous other applications.

Vent silencers are used to silence high velocity air or gas, including steam, flowing to and from the atmosphere, while also finding use in reducing discharge noises on air cylinders, vent lines, air motors, and the like.

One common form of vent silencer is the splitter type in which a perforated, rounded-nose bullet or splitter is mounted within the silencer housing and contains sound absorbing material. Sound energy passes through the holes or perforations and is absorbed in the material within the splitter.

A second common type of vent silencer is the tube-type in which a series of parallel perforated tubes are mounted within the housing and a sound absorbing material is packed around the tubes. The tube-type silencer acts to enhance the effectiveness of the sound absorbing material by providing an increased ratio of perimeter to flow passage cross sectional area.

A critical parameter in tube-type vent silencers is the length to diameter ratio of the tube. The silencer is typically rated or graded according to such ratio. For example a grade 10 silencer has a length to diameter ratio of the tube of 10. A grade 20 silencer has a length to diameter ratio of 20. A grade 30 silencer has a length to diameter ratio of 30. The grade level is a measure of acoustical silencing or damping. To accommodate a desired amount of exhaust gas or air flow through the silencer, a given total cross sectional area of the tubes is required, which in turn determines the number and/or diameter of the tubes, which further in turn determines the length of the tubes, to achieve a desired rating or grade.

In the past, the tubes have been welded to the divider walls in the housing. This is a costly and highly labor-intensive operation. Furthermore, this requires a trade-off in selecting the number of tubes versus the diameter of the tubes. It is desirable to have as many tubes as possible for a given cross sectional area flow requirement because the smaller the diameter of the tube the lesser the length of the tube required to maintain the requisite length to diameter ratio. The shorter tube lengths also provide a lower weight and shorter overall structure which is more desirable in various applications. However, the higher the number of tubes, the more welding operations required, which in turn increases cost. In order to keep cost down, including welding cost, it is typical to employ a small number of large diameter tubes. The trade-off is the longer length of tube required to maintain the requisite length to diameter ratio, which increased length adds weight and requires more axial space.

The present invention addresses and solves the above noted problems, and provides simplified cost-effective structure enabling a high number of small diameter short length tubes without the above noted cost trade-off. The invention also enables maximum use of the cross sectional area within the housing by enabling selection of the proper number of tubes to fill a circular housing in the most space-efficient pattern.

BRIEF DESCRIPTION OF THE DRAWINGS

FIG. 2 is a sectional view taken along line 2—2 of FIG. 1.

FIG. 3 is an enlarged view of a portion of the structure of FIG. 2.

DETAILED DESCRIPTION

Figure 1:
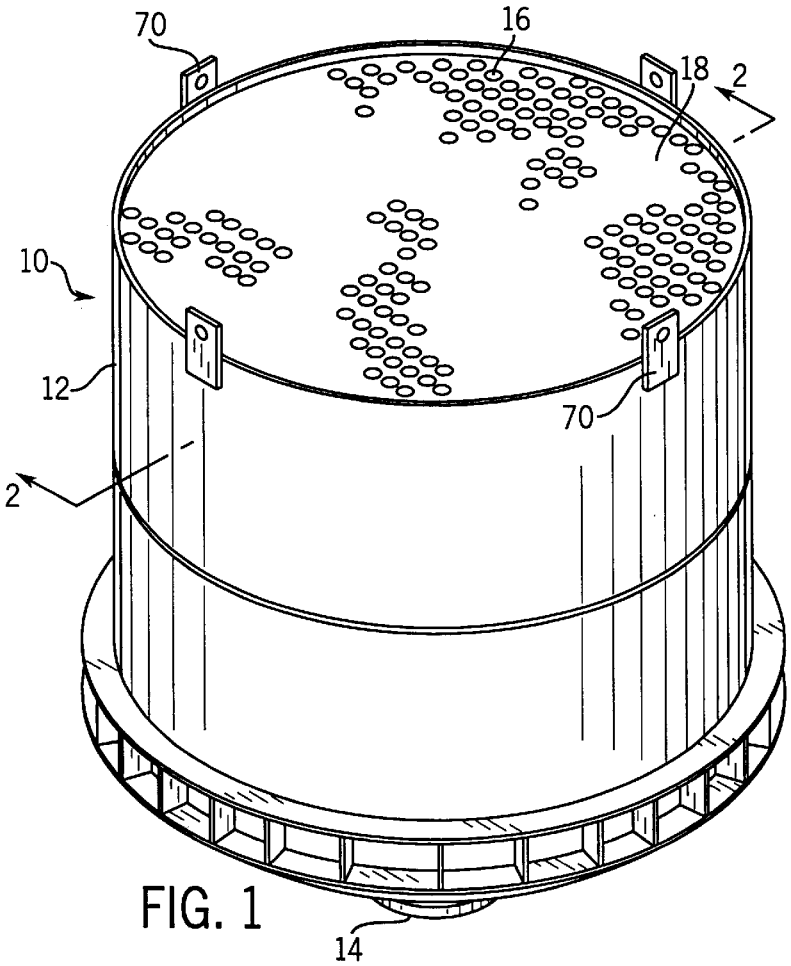
FIG. 1 is a perspective view of an acoustical silencer in accordance with the invention.
Figure 4:
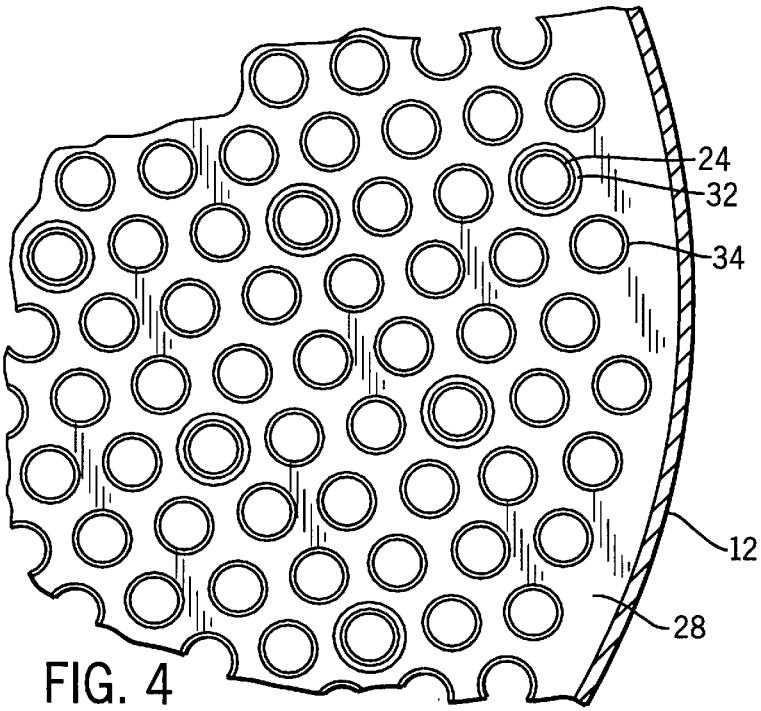
FIG. 4 is a sectional view taken along line 4—4 of FIG. 2.

FIGS. 1 and 2 show an acoustical vent silencer 10 including a generally cylindrical housing 12 extending generally axially vertically upwardly from an inlet 14 to an outlet 16. A laterally extending circular disc-like upper plate or divider wall 18 is attached to the housing by welding the outer periphery of upper divider wall 18 to the housing at weldment 20, FIGS. 2 and 3. Upper divider wall 18 has a plurality of apertures 22 therethrough, FIG. 3. A plurality of tubes 24 extend axially vertically through the respective apertures and have an integral bulge 26 radially crimped outwardly to a larger radius than aperture 22 and engaging the topside of upper divider wall 18 to suspend tube 24 therefrom. A laterally extending circular disc-like lower plate or divider wall 28, FIGS. 2–4, has a plurality of apertures 30 therethrough. The tubes 24 extend axially vertically through respective apertures 30 of lower divider wall 28. Some of the tubes 24 have an integral bulge 32 crimped radially outwardly to a larger radius than aperture 30 and engaging the underside of lower divider wall 28 to suspend lower divider wall 28 from tubes 24. Some of the tubes such as 34, FIG. 3, do not have the lower bulge such as 32 and merely pass through lower divider wall 28 without supporting the latter. Each of the tubes has an upper bulge 26, such that each tube is suspended from upper divider wall 18. However, not all of the tubes need have a lower bulge such as 32. Lower divider wall 28 is suspended from those tubes which have a lower bulge such as 32. Lower divider wall 28 is unattached to housing 12 and is suspended in floating relation therein.

It is preferred that the upper end of tube 24 have a second integral bulge 36 crimped radially outwardly to a larger radius than aperture 22. This facilitates manufacturing assembly. The structure is assembled on its side by initially inserting tubes 24 horizontally into apertures 22. A crimping tool is then inserted into the end of tube 24 and radially expanded outwardly to form bulges 26 and 36. This locates tube 24 relative to divider wall 18, and prevents the tube from sliding further into or out of aperture 22. Acoustically absorptive pack material 38, such as woven fiber, fiberglass, or the like, is packed into the housing around tubes 24. Divider wall 28 is then inserted into the housing such that the tubes extend through respective apertures 30, and the noted crimping tool is then inserted into the other end of the tubes and radially expanded outwardly to form integral bulges 32 and 40, the latter being desired to locate wall 28 in place and prevent movement of same toward wall 18.

Figure 5:
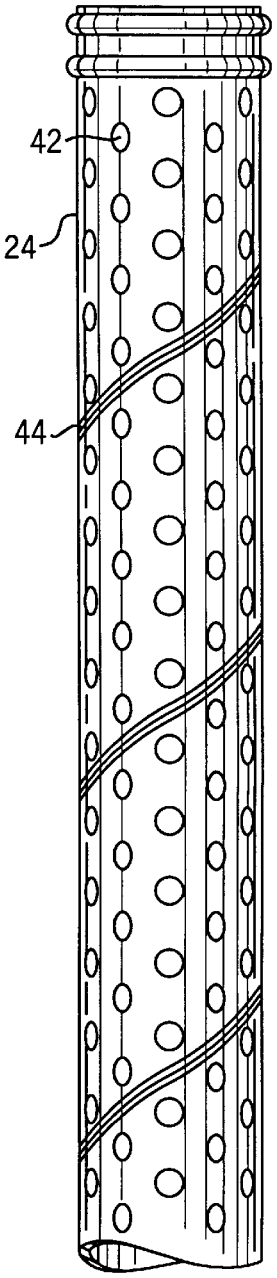
FIG. 5 is a side elevation view of a portion of the structure of FIG. 2.

Tubes 24, 34 are metal spiral-wound members having a plurality of perforations 42, FIG. 5. Spiral-wound tubes are known in the prior art. The formed spiral joint 44 is a mechanical crimp, not a weld. Spiral-wound tubes may be purchased in any length desired, or a spiral winding machine may be used to form the tubes to a desired length, all as is known in the prior art. The use of spiral-wound tubes and the above noted suspension structure in combination enable the tubes to be completely weldless, including along their entire length and including at their interface with each of divider walls 18 and 28.

Divider wall 28 divides the housing into an upstream chamber 46, FIG. 2, communicating with inlet 14, and a downstream chamber 48. Divider wall 18 in housing 12 is between downstream chamber 48 and outlet 16. A diffuser 50, similar to diffuser 7 in incorporated U.S. Pat. No. 4,108,276, is in upstream chamber 46 and receives sound energy from inlet 14 and diffuses the sound energy into upstream chamber 46. Tubes 24, 34 in downstream chamber 48 extend between divider walls 18 and 28 and transmit and reduce sound energy from upstream chamber 46 to outlet 16. Diffuser 50 is a cylindrical member closed at its inner end by cap 52, and having a plurality of perforations 54 in its cylindrical sidewall emitting sound energy radially laterally as shown at arrow 56, which sound energy then travels axially longitudinally as shown at arrow 58 through tubes 24, 34 enabling the latter to transmit and reduce sound energy from the inlet to the outlet of the housing. The upstream end of the diffuser is preferably double walled, with acoustically absorptive pack material 60 between the walls. Likewise, the upstream end of housing 12 is double walled, with acoustically absorptive pack material 62 between the walls. The upstream chamber is double walled with acoustically absorptive pack material 64 between walls 12 and 66. In one embodiment, the housing includes an outer circumferential support skirt 68 for mounting and installation. The downstream end of the housing preferably includes lift lugs such as 70 also for mounting and installation.

It is recognized that various equivalents, alternatives and modifications are possible within the scope of the appended claims.

We claim:

1. An acoustical silencer comprising a housing having an inlet and an outlet and extending generally axially vertically upwardly from said inlet to said outlet, a laterally extending upper divider wall attached to said housing, said upper divider wall having at least one aperture therethrough, at least one tube extending axially vertically through said aperture and having an integral bulge crimped radially outwardly to a larger radius than said aperture and engaging the topside of said upper divider wall to suspend said tube therefrom, a laterally extending lower divider wall having at least one aperture therethrough, said tube extending axially vertically through said aperture of said lower divider wall and having an integral bulge crimped radially outwardly to a larger radius than said aperture of said lower divider wall and engaging the underside of said lower divider wall to suspend said lower divider wall from said tube, wherein each of said divider walls has a plurality of apertures therethrough, and comprising a plurality of said tubes, each said tube extending through a respective aperture of said upper divider wall and a respective aperture of said lower divider wall, each of said tubes having an upper said integral bulge, such that each tube is suspended from said upper divider wall, at least some of said tubes having a lower said integral bulge, such that said lower divider wall is suspended from at least some of said tubes, wherein said lower divider wall is unattached to said housing and is suspended in floating relation therein, wherein said suspension of said tubes from said upper divider wall by engagement of said upper integral bulges with the topside of said upper divider wall is the sole connection of said tubes to said upper divider wall, such that said tubes are connected to said upper divider wall without welding, and wherein suspension of said lower divider wall from at least some of said tubes by engagement of said lower integral bulges with the underside of said lower divider wall is the sole connection of said tubes to said lower divider wall, such that the tubes which are connected to said lower divider wall are connected without welding, said tubes extending through respective said apertures in said divider walls in loose fit relation without crimping of said divider walls at said apertures to conform to said crimped bulges of said tubes, such that said upper bulge suspends and supports the bulged member itself, namely said tube, in free hanging relation, and said lower bulge suspends and supports another, different member, namely said lower divider wall, in free hanging relation.

2. The invention according to claim 1 wherein said upper divider wall is welded to said housing.

3. The invention according to claim 1 wherein said tubes are continuous perforated members, each of which is completely weldless, including along its entire length and including at its interface with each of said divider walls.

4. The invention according to claim 3 wherein said tubes are continuous spiral-wound perforated members.

5. An acoustical silencer comprising a housing having an inlet for receiving sound energy and having an outlet, a first divider wall in said housing dividing said housing into an upstream chamber communicating with said inlet and a downstream chamber, a second divider wall in said housing between said downstream chamber and said outlet, a diffuser in said upstream chamber receiving sound energy from said inlet and diffusing said sound energy into said upstream chamber, a plurality of tubes in said downstream chamber extending between said first and second divider walls and transmitting sound energy from said upstream chamber to said outlet, wherein said housing extends axially vertically from said inlet upwardly to said outlet, said second divider wall is supported by said housing, said tubes are supported by said second divider wall and hang downwardly therefrom, each of said divider walls has a plurality of apertures therein respectively receiving said tubes, each said tube has a first integral bulge crimped radially outwardly to a larger radius than the respective aperture of said second divider wall and engaging the topside of said second divider wall to suspend the respective said tube therefrom, at least some of said tubes have a second integral bulge crimped radially outwardly to a larger radius than the respective aperture of said first divider wall and engaging the underside of said first divider wall to suspend said first divider wall therefrom, such that said first bulge suspends and supports the bulged member itself, namely said tube, in free hanging relation, and said second bulge suspends and supports another, different member, namely said first divider wall, in free hanging relation, the interface of said tubes and each of said divider walls at said apertures being weldless.

6. The invention according to claim 5 wherein said tubes are completely weldless, including along their entire length and including at their interface with each of said divider walls.

7. An acoustical silencer comprising a housing having an inlet and an outlet and extending generally axially vertically upwardly from said inlet to said outlet, a laterally extending upper divider wall attached to said housing, said upper divider wall having at least one aperture therethrough, at least one tube extending axially vertically through said aperture and having an integral bulge crimped radially outwardly to a larger radius than said aperture and engaging the topside of said upper divider wall to suspend said tube therefrom, a laterally extending lower divider wall having at least one aperture therethrough, said tube extending axially vertically through said aperture of said lower divider wall and having an integral bulge crimped radially outwardly to a larger radius than said aperture of said lower divider wall and engaging the underside of said lower divider wall to suspend said lower divider wall from said tube, wherein each of said divider walls has a plurality of apertures therethrough, and comprising a plurality of said tubes, each said tube extending through a respective aperture of said upper divider wall and a respective aperture of said lower divider wall, each of said tubes having an upper said integral bulge, such that each tube is suspended from said upper divider wall, at least some of said tubes having a lower said integral bulge, such that said lower divider wall is suspended from at least some of said tubes, wherein at least some of said tubes have first, second and third integral bulges, said first integral bulge being said upper bulge engaging the top side of said upper divider wall, said second integral bulge being said lower bulge engaging the underside of said lower divider wall, said third integral bulge being proximate said first integral bulge and spaced therebelow by at least the width of said upper divider wall to locate the respective tube relative to said upper divider wall and prevent such tube from sliding further into or out of the respective aperture in said upper divider wall.

8. An acoustical silencer comprising a housing having an inlet and an outlet and extending generally axially vertically upwardly from said inlet to said outlet, a laterally extending upper divider wall attached to said housing, said upper divider wall having at least one aperture therethrough, at least one tube extending axially vertically through said aperture and having an integral bulge crimped radially outwardly to a larger radius than said aperture and engaging the topside of said upper divider wall to suspend said tube therefrom, a laterally extending lower divider wall having at least one aperture therethrough, said tube extending axially vertically through said aperture of said lower divider wall and having an integral bulge crimped radially outwardly to a larger radius than said aperture of said lower divider wall and engaging the underside of said lower divider wall to suspend said lower divider wall from said tube, wherein each of said divider walls has a plurality of apertures therethrough, and comprising a plurality of said tubes, each said tube extending through a respective aperture of said upper divider wall and a respective aperture of said lower divider wall, each of said tubes having an upper said integral bulge, such that each tube is suspended from said upper divider wall, at least some of said tubes having a lower said integral bulge, such that said lower divider wall is suspended from at least some of said tubes, at least some of said tubes have first, second and third integral bulges crimped radially outwardly, said first integral bulge being said upper bulge engaging the top side of said upper divider wall, said second integral bulge being said lower bulge engaging the underside of said lower divider wall, said third integral bulge being proximate said second integral bulge and spaced thereabove by at least the width of said lower divider wall and locating said lower divider wall in place and preventing movement of same toward said upper divider wall.

9. An acoustical silencer comprising a housing having an inlet and an outlet and extending generally axially vertically upwardly from said inlet to said outlet a laterally extending upper divider wall attached to said housing, said upper divider wall having at least one aperture therethrough, at least one tube extending axially vertically through said aperture and having an integral bulge crimped radially outwardly to a larger radius than said aperture and engaging the topside of said upper divider wall to suspend said tube therefrom a laterally extending lower divider wall having at least one aperture therethrough, said tube extending axially vertically through said aperture of said lower divider wall and having an integral bulge crimped radially outwardly to a larger radius than said aperture of said lower divider wall and engaging the underside of said lower divider wall to suspend said lower divider wall from said tube, wherein each of said divider walls has a plurality of apertures therethrough, and comprising a plurality of said tubes, each said tube extending through a respective aperture of said upper divider wall and a respective aperture of said lower divider wall, each of said tubes having an upper said integral bulge, such that each tube is suspended from said upper divider wall, at least some of said tubes having a lower said integral bulge, such that said lower divider wall is suspended from at least some of said tubes, wherein at least some of said tubes have first, second, third and fourth integral bulges crimped radially outwardly, said first integral bulge being said upper bulge engaging the top side of said upper divider wall, said second integral bulge being said lower bulge engaging the underside of said lower divider wall, said third integral bulge being proximate said first integral bulge and spaced therebelow by at least the width of said upper divider wall and locating the tube relative to said upper divider wall and preventing the tube from sliding further into or out of the respective aperture, said fourth integral bulge being proximate said second integral bulge and spaced thereabove by at least the width of said lower divider wall to locate said lower divider wall in place and prevent movement of same toward said upper divider wall.

10. The invention according to claim 9 wherein said tubes comprise a first group of tubes each having said first, second, third and fourth integral bulges, and a second group of tubes each having only two integral bulges crimped radially outwardly, namely a first bulge engaging the top side of said upper divider wall, and a second bulge proximate said first bulge and spaced therebelow by at least the width of said upper divider wall.

11. An acoustical silencer comprising an axially vertically extending housing having a lower inlet and an upper outlet, a pair of upper and lower spaced divider walls in said housing, each divider wall having a plurality of apertures therethrough, a plurality of tubes each extending through a respective aperture in each of said divider walls in loose fit relation without welding and without rigid mechanical lock joint crimping of said divider walls to said tubes, said tubes hanging downwardly from and being suspended by and supported by said upper divider wall, said lower divider wall being suspended by and supported by said tubes.

* * * * *